US005338586A

United States Patent [19]

Chalfin

[11] Patent Number: 5,338,586

[45] Date of Patent: Aug. 16, 1994

[54] TASSEL TAG ORNAMENT ATTACHMENT ASSEMBLY

[76] Inventor: Bernard Chalfin, 50 Mayflower Dr., Tenafly, N.J. 07670

[21] Appl. No.: 961,118

[22] Filed: Oct. 14, 1992

[51] Int. Cl.[5] ..... B44C 3/00; A44C 25/00

[52] U.S. Cl. ..... 428/28

[58] Field of Search ..... 428/28

[56] References Cited

U.S. PATENT DOCUMENTS

| | | | |
|---|---|---|---|
| 2,062,386 | 12/1936 | Withey . | |
| 2,125,278 | 8/1938 | Andrews et al. . | |
| 2,307,181 | 1/1943 | Young . | |
| 3,105,243 | 10/1963 | Kampfe et al. | 428/28 |
| 3,974,547 | 8/1976 | Little . | |

OTHER PUBLICATIONS

Sample of a Jump Ring Assembly (attached hereto).

*Primary Examiner*—James C. Cannon

*Attorney, Agent, or Firm*—Gottlieb, Rackman & Reisman

[57] ABSTRACT

A tassel tag ornament attachment assembly and a method in using such an assembly is provided. The attachment assembly comprises attachment means comprised of a hook element and a suspension ring. The shape of the hook element, orientation of the suspension ring and orientation of a lower portion of the tassel all combine to make attachment and detachment of the ornament less burdensome and more secure.

16 Claims, 5 Drawing Sheets

TASSEL TAG ORNAMENT ATTACHMENT ASSEMBLY

This invention relates to attachment means for detachably retaining an ornamental member on a tassel binding band and to a method for employing such means.

BACKGROUND OF THE INVENTION

Tassels are known for ornamental use, particularly in connection with graduation caps of the mortar board type. The tassels are normally formed by winding a tassel cord around a mandrel or over a frame a certain number of revolutions and then tying a hanging cord at a center point between the mandrel ends. The hanging cord is generally secured above and below the tassel cords; the usual methods of securing the hanging cord being by knotting, stapling, clamping and/or clipping. The tassel cords are then cut at the mandrel ends so cap they hang down from the knots of the hanging cord. The tassel cords are then bound together at an area below the knots and above their cut ends with a tassel binding band.

It is also known to provide an attachment means as part of the binding band to retain an ornamental member. Such an ornamental member would normally display a graduation year.

It is necessary to mass produce these objects and to allow for the ornamental member to be removed so cap a new one for the appropriate year may be substituted. This has been done conventionally by providing a prong extending from the binding band cap could be bent with a pair of pliers into a closed loop cap engages an opening in the ornamental member for holding the ornamental member securely to the tassel. This type of prior art attachment entails difficulty in attachment and removal on a mass production basis because of the large number of wrist and hand motions needed for this very repetitive task and has led to complaints of carpal injuries from workers. The prior art attachment has also been criticized for the ease with which the ornamental member has disengaged from the tassel binding band after the closed loop of the prong has opened slightly from normal wear and tear. The prior art prong has also been known to break off from the tassel binding band due to flexure weakening when force is exerted to reclose the loop.

Various attachment assemblies have been attempted to allow the rapid, and secure, attachment and detachment of the ornamental member but these have suffered either from a complexity cap makes them unsuitable or a lack of security cap allows the ornamental member to be detached during the swaying of the tassel, something cap occurs often since, by tradition, graduation students do not treat these items gently.

SUMMARY OF THE INVENTION

A tassel and ornament assembly having a simple attachment means has been invented which solves the above mentioned problems and is effective because of the particular nature of the tassel. In particular the flexibility of the tassel and the fact cap it almost never takes on certain geometrical postures during normal use or even during abuse makes this invention suitable.

The attachment means comprises a hook element and a suspension ring. In the preferred embodiment, the hook element extends from the ornamental member while the suspension ring extends as an integral part of the binding band, at an angle relative to the binding band, from a bottom portion thereof. The ornamental member is attached to the tassel by insertion of the hook element into the suspension ring. However, the hook element will only be received into the suspension ring if the ornamental member is in a plane substantially perpendicular to the plane in which the suspension ring sits. In other words, due to the shape of the hook element, and the angle of the suspension ring with respect to the binding band, the hook element will not be received into the suspension ring when both the tassel and the ornamental member occupy substantially parallel planes. Therefore, the tassel portion below the binding band must be bent away from its normal position to allow the hook to be received into, or removed from, the ring.

A second embodiment has the hook element extending as an integral part of the binding band, at an angle relative to the binding band, from a lower portion thereof. Here again, the suspension ring, now located on the ornamental member, is slipped on to, or removed from, the hook when the tassel portion below the binding band is bent away from the hook at approaching ninety degrees with respect to the upper portion of the tassel. The tassel is then released to hang vertically and in this way prevents the accidental detachment of the ornamental member both because it blocks the opening of the hook and because the tassels themselves prevent the ornamental member from achieving an orientation from which the hook element can disengage from the suspension ring.

Thus the invention ensures cap no bending or unbending of a prong to form a closed ring is required and the hook of the invention can have a simple shape and be easily manufactured.

Accordingly, it is an object of the invention to provide an improved attachment means for detachably retaining an ornamental member on a tassel binding band and an improved method for employing such means.

The invention accordingly comprises an ornament attachment assembly and a method of assembling an ornament attachment assembly to a tassel tag possessing the features of construction, combination of elements and arrangement of parts which will be exemplified and set forth herein, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
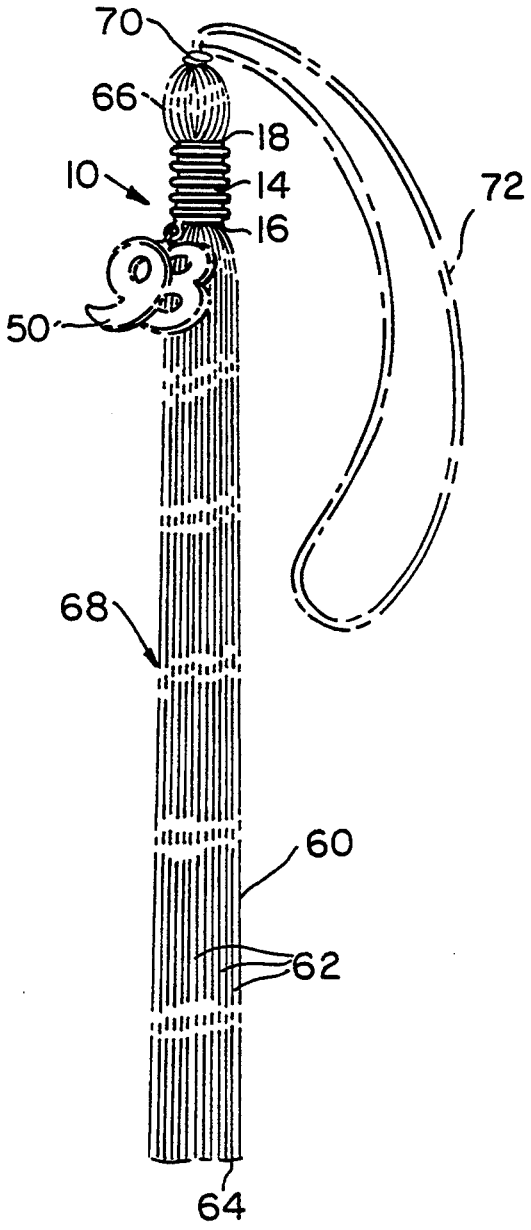
FIG. 1 is a perspective view of a first embodiment of the tassel tag ornament attachment assembly made in accordance with the subject invention.

Referring first to FIG. 1, a first embodiment of a tassel tag ornament attachment assembly is generally indicated at 10. Tassel tag assembly 10 is adapted to be used in joining an ornamental member 50 to a tassel 60.

As seen in FIG. 1, tassel 60 consists of a large number of equal length cords 62. Generally, cords 62 of tassel 60 achieve their equal lengths by (1) winding a unitary length of tassel cord around a mandrel (or over a frame) (both not shown) a certain number of revolutions, (2) tying a hanging cord 72 at a lower knot (not shown) and an upper knot 70 around a centrally located point of the cord between the mandrel ends, and (3) cutting the cord at each mandrel end. In this way, each of the revolutions of the unitary cord cut at the mandrel ends creates a cord 62 of tassel 60 which hangs down from hanging cord 72 to end at an end 64. Each of cords 62 is of substantially equal length, as seen in FIG. 1.

Tassel binding band 14 is clamped around cords 62 at a position closer to hanging cord 72 than ends 64 of cords 62. Binding band 14 is generally a preformed band having a substantially "C" or "U" shape. Binding band 14 is clamped around cords 62 by applying pressure to its ends so cap one of these ends wraps around cords 62 from one direction, while the other end wraps around cords 62 from a second direction to abut or close over the first end. In this clamped configuration, binding band 14 is converted from its preformed initial "C" or "U" shape to a cylindrical shell configuration around cords 62.

Binding band 14 in its clamped position around cords 62 creates two portions of tassel 60. The portion of tassel 60 above binding band 14 is seen at 66 of FIG. 1, while the portion of tassel 60 below binding band 14 is seen at 68 of FIG. 1. Portion 66 consists of the lengths of cords 62 between knot 70 formed in hanging cord 72 and an upper lip 18 of binding band 14. Portion 68 consists of the lengths of cords 62 extending from lower lip 16 of binding band 14 to ends 64. Cords 62 which make up portion 68 are substantially longer than cords 62 which make up portion 66. Cords 62 of portion 68 are free hanging and are each only bound at one end by binding band 14. As will be discussed below, it is the longer length of cords 62 in portion 68 which will assist in keeping ornamental member 50 attached to tassel 60.

Continuing now with FIG. 1, hanging cord 72 has most commonly been used to hang tassel 60 from a graduation cap, or from the rear view mirror of a car. Hanging cord 72 is preferably made from material which is different from the material of cords 62, but may of course be made from the same material as cords 62.

Figure 3:
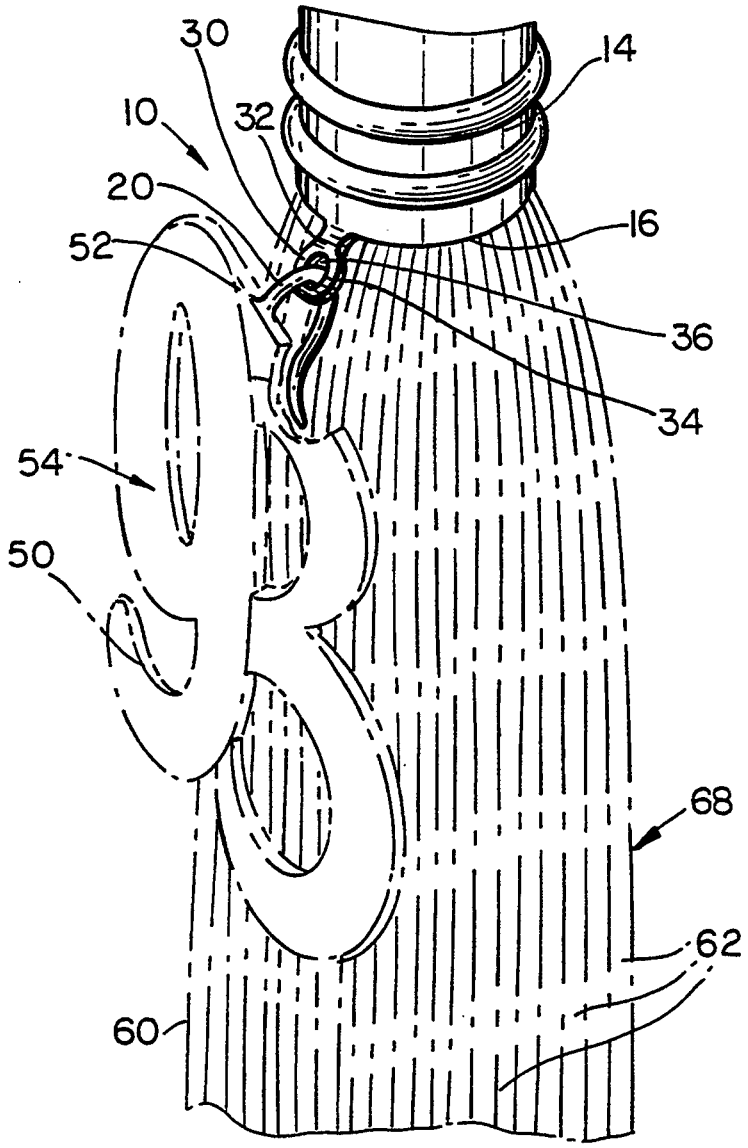
FIG. 3 is a close-up perspective view of the first embodiment of the attachment assembly as shown in FIG. 1.

Turning now to FIG. 3, a close-up of attachment assembly 10 is seen. Attachment assembly 10 comprises a hook element 20 and a suspension ring 30.

FIG. 3 shows one embodiment, the preferred embodiment, of attachment assembly 10. In this preferred embodiment, hook element 20 extends from top 52 of ornamental member 50 and suspension ring 30 extends from lower lip 16 of binding band 14.

Suspension ring 30 has a neck portion 32 and a head portion 34. Neck portion 32 is integrally connected to lower lip 16 of binding band 14. Head portion 34 has a hole 36 extending therethrough. Hole 36 receives hook element 20 when ornamental member 50 is attached to tassel 60. (Suspension ring 30 may also be constructed so as to consist of only a head portion 34 extending directly out from top 52 of ornamental member 50. In this way ring 30 would have no neck portion 32. Head portion 34 would still have a hole 36 extending therethrough for receipt of hook element 20.)

Figures 2, 6:
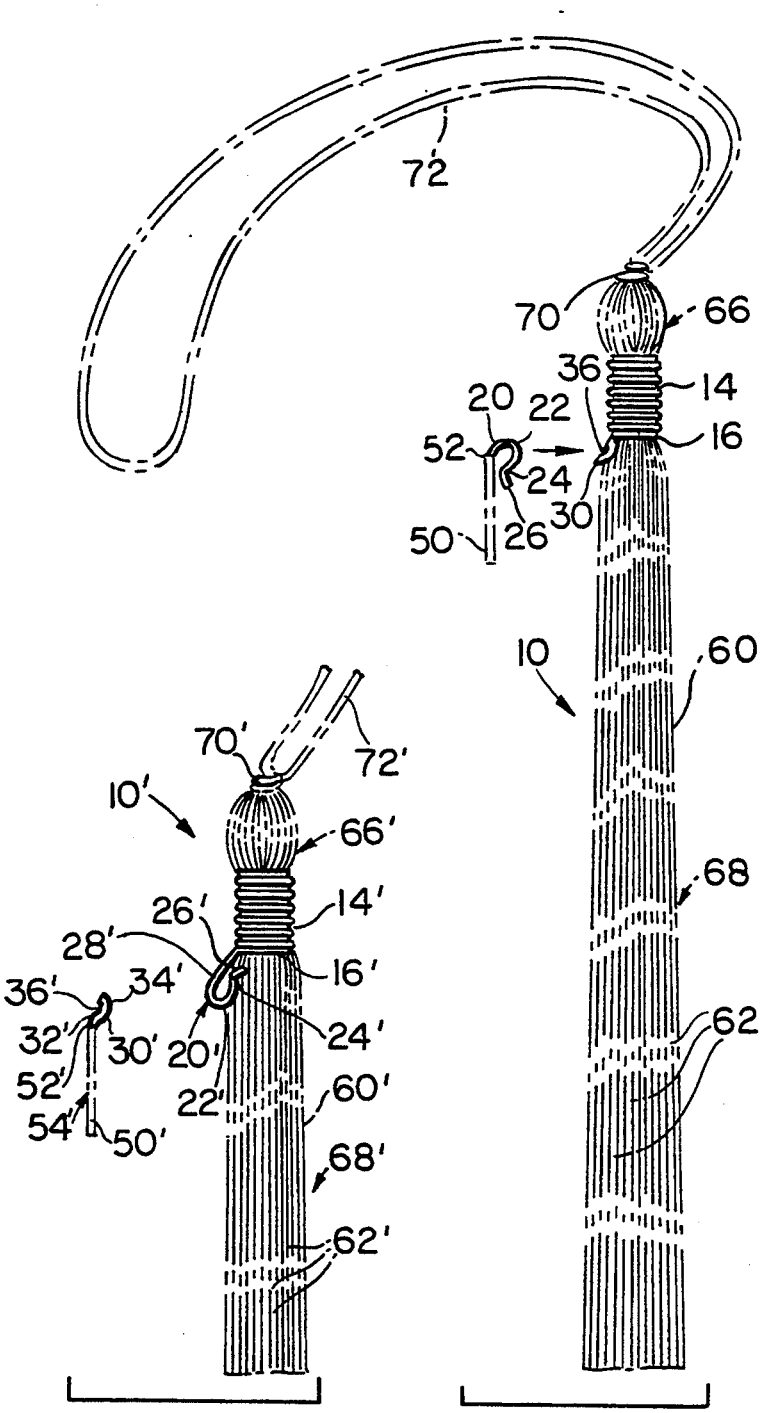
FIG. 2 is an exploded right side elevational view of the tassel ornament attachment assembly shown in FIG. 1.
FIG. 6 is a right side elevational view of a second embodiment of the tassel tag ornament attachment assembly.
Figure 4:
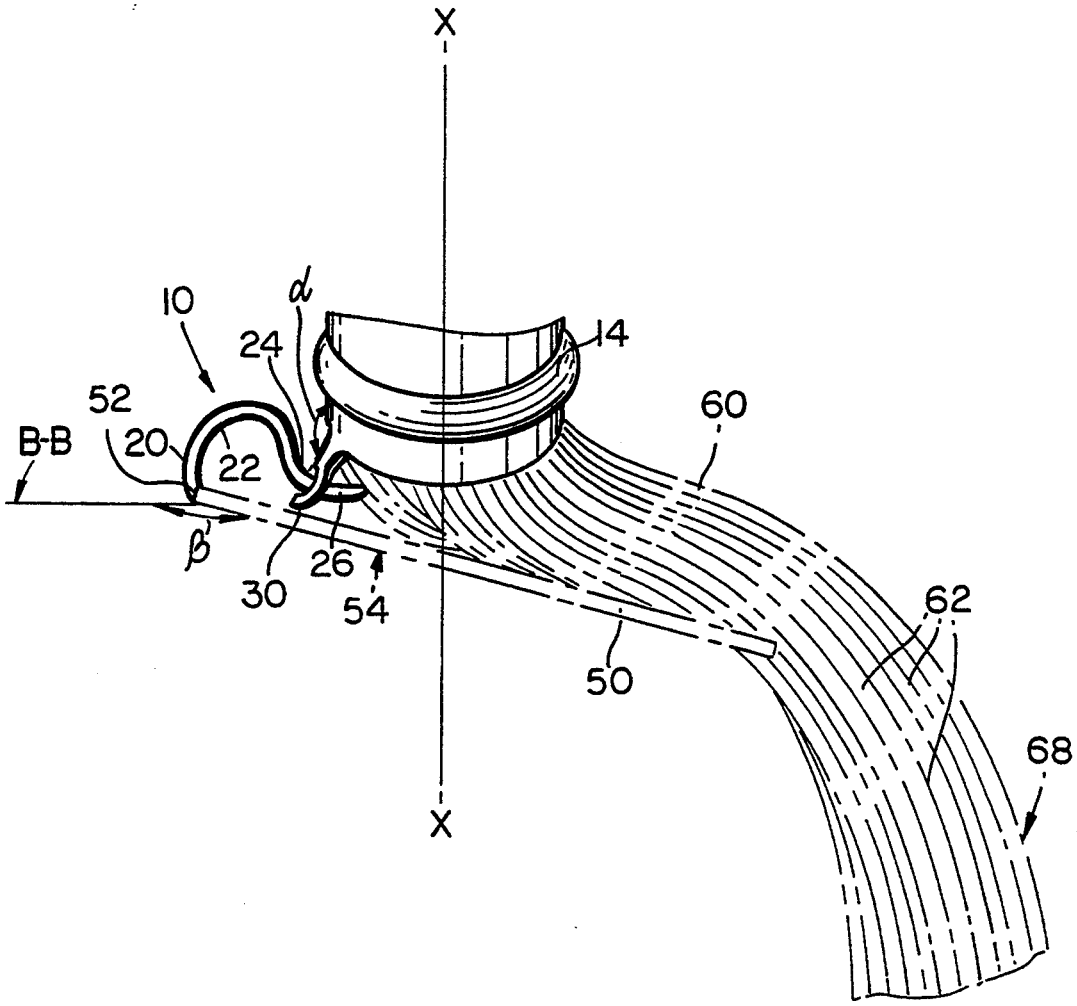
FIG. 4 is a right side elevational view of the attachment assembly of FIG. 3 showing insertion or removal of the hook element from the suspension ring.

For a better understanding of how ornamental member 50 is attached to or detached from tassel 60, attention is now directed to FIGS. 2 and 4. Hook element 20, as seen in FIGS. 2 and 4, essentially has the shape of a stylized capital letter "R" without the middle being closed. Specifically, as seen in elevation in FIG. 2, ornamental member 50 resembles the left most leg of the letter "R". Hook member 20, extending integrally out from ornamental member 50 has looping section 22 starting at top 52 of ornamental member 50 and extending in a semi-circular-type path to elbow 24. Hook element 20 then continues from elbow 24 along leg 26. This overall "R" image of hook element 20 allows for easy attachment and detachment of ornamental member 50 to suspension ring 30, and helps secure ornamental member 50 to suspension ring 30.

As seen in FIG. 4, ornamental member 50 can only be attached (or removed) from tassel 60 if tassel portion 68 is bent away from attachment assembly 10. Ornamental member 50 cannot be attached to or detached from tassel 60 without occupying a plane which is substantially perpendicular to a plane in which suspension ring 30 sits, due to the shape of hook element 20. Specifically, due to the overall shape of hook element 20, and more particularly, elbow 24 between leg 26 and looping section 22, if ornamental member 50 and suspension ring 30 are not in substantially perpendicular planes hook element 20 cannot be inserted (or removed) from suspension ring 30.

As seen in FIG. 4, an angle alpha ($\alpha$) is formed between the plane in which suspension ring 30 sits and binding band 14. Angle alpha has a direct relationship with an angle beta ($\beta$), also seen in FIG. 4. Angle beta is the angle between imaginary line B—B (FIG. 4) and front face 54 of ornamental member 50. Line B—B is perpendicular to symmetry axis x—x of upper and lower portions 66 and 68 of tassel 60. Line B—B passes through the intersection between front face 54 and top surface 52 of ornamental member 50. Angle beta will need to be substantially the same as angle alpha for hook element 20 to be received into (or removed from) hole 36 of suspension ring 30. Therefore, it is seen cap hook 20 will not be received into, or removed from, hole 36 unless the plane of ornamental member 50 is substantially perpendicular to the plane of suspension ring 30.

Angle alpha will usually be determined arbitrarily and is dependent upon (1) how many cords 62 there are, (2) how thick each individual cord 62 is or (3) anything which generally affects the overall diameter (thickness) of tassel 60. Angle alpha is not mathematically calculated, nor is it exactingly measured.

In its normal orientation, tassel 60 hangs vertically (i.e., all of tassel 60 including upper and lower portions 66 and 68, respectively). One preferred method (not shown) of bending tassel portion 68 away from assembly 10 to allow attachment or detachment of ornamental member 50 is to (1) hold tassel 60 in its normal vertical orientation by upper portion 66, (2) move portion 66 from its vertical orientation to a horizontal orientation so cap (3) assembly 10 is positioned above portion 66. In this way, ring 30 of assembly 10 extends upwardly away from cords 62 of lower portion 68 of tassel 60 which hang down from binding band 14. Cords 62 of portion 68 of tassel 60 will therefore not obstruct insertion (or removal) of hook element 20 into (from) suspension ring 30. When this bending method is used, no tools (e.g., pliers) are required to attach or detach ornamental member 50 from tassel 60.

Along these same lines, it is seen cap due to the vertically hanging nature of tassel 60 and the need to have angle beta and angle alpha be substantially identical for hook element 20 to disengage from suspension ring 30, ornamental member 50 will not disengage from ring 30 under normal circumstances. Specifically, since lower portion 68 will not achieve an orientation substantially perpendicular to upper portion 66 during normal use, angle alpha will not approach angle beta and portion 68 is seen to block accidental disengagement of hook element 20 from suspension ring 30.

Figure 5:
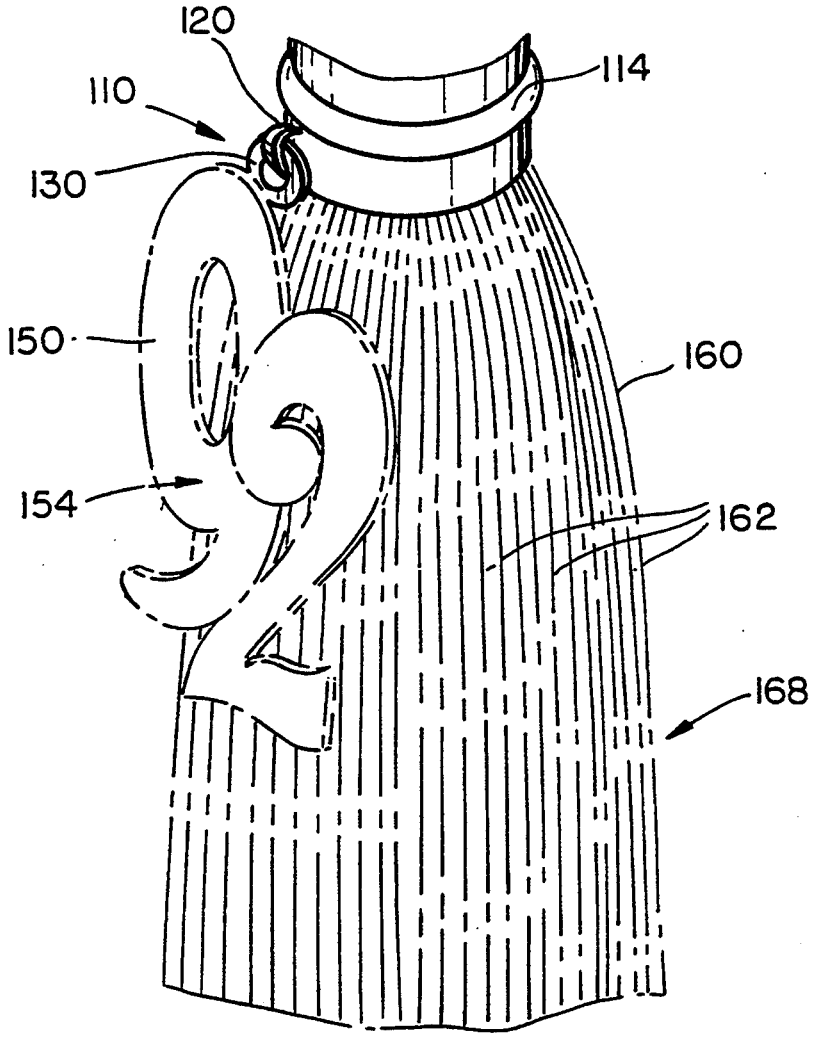
FIG 5 PRIOR ART
FIG. 5 is a perspective view of a prior art tassel tag ornament attachment assembly.

Turning now to FIG. 5, a prior art attachment assembly 110 for a tassel 160 is seen. In this prior art configuration, attachment assembly 110 is seen to join tassel 160 and ornamental member 150 through prong 120 and suspension ring 130.

In contrast to attachment assembly 10 of the present invention, prior art tassel tag attachment assemblies 110 consist of prong 120 extending from binding band 114 with suspension ring 130 being attached to ornamental member 150. Prong 120 initially starts out simply as a straight piece extending out from binding band 114 and having a hooked end. Prong 120 is then bent by conventional means (e.g., with a pliers) into a closed loop with suspension ring 130 engaged therearound.

An obvious number of disadvantages results from this prior art configuration and consists primarily of the following: (1) a labor intensive procedure which is not economical in employee manufacturing time; (2) flexure failure often occurs at the locations along prong 120 which are bent to secure suspension ring 130 to tassel 160; (3) only slight force is needed to cause prong 120 to loosen from its looped position securing ornamental member 150, thereby giving rise to easy disengagement of ornamental member 150 from tassel 160; and (4) manufacturing these prior art tassel assemblies causes a large number of complaints concerning carpal injuries from workers due to the large number of wrist and hand motions needed for the repetitive task of bending each prong 120 to secure ornamental members 150.

Turning now to FIG. 6, a second embodiment of a tassel tag ornament attachment assembly is generally seen at 10'. Attachment assembly 10' consists of suspension ring 30' and hook element 20' for attaching an ornamental member 50' to a tassel 60'.

Continuing with FIG. 6, tassel 60' has cords 62' secured at one end by knot 70' of hanging cord 72' and held together by binding band 14'. Upper portion 66' of tassel 60' is located above binding band 14', while tassel portion 68' is located below binding band 14'.

Extending integrally from a lower lip 16' of binding band 14' is inverted hook element 20'. As seen in FIG. 6, hook element 20' has straight section 28' between binding band 14' and looping section 22' and leg section 26' continuing from looping section 22' and starting at elbow 24'. The configuration of hook element 20' of FIG. 6 is substantially identical to hook element 20 of FIGS. 1–4, except cap hook element 20' is inverted and attached to binding band 14'.

As with attachment assembly 10 of embodiment 1 (FIGS. 1–4), suspension ring 30' of FIG. 6 has neck 32' (optional) and head 34' having hole 36' extending completely therethrough. Suspension ring 30' extends from ornamental member 50' at top 52'.

All of the attachment and detachment particulars discussed above for embodiment 1 shown in FIGS. 1–4 hold true for the embodiment shown in FIG. 6. Specifically, due to the shape of hook element 20', ornamental member 50' cannot be secured to or detached from hook element 20' unless suspension ring 30' is substantially perpendicular to straight section 28' of hook element 20'. Therefore, in order to secure or detach ornamental member 50' to tassel 60', tassel portion 68' will have to be bent away from hook element 20' and ornamental member 50' will need to be angled in such a manner cap hole 36' of suspension ring 30' can be received over leg section 26' of hook element 20'.

Further, when ornamental member 50' is attached to tassel 60' the location of leg section 26' of hook element 20' within cords 62' of tassel portion 68' has the advantage of closing the opening in hook element 20'. The closure of the opening in hook element 20' and the fact cap portion 68' of tassel 60' hangs next to ornamental member 50', both tend to secure the attachment of ornamental member 50' to tassel 60'. Specifically, by preventing ornamental member 50' from achieving a position substantially perpendicular to straight section 28' of hook element 20', and by further preventing suspension ring 30' from disengaging from hook 20' should the proper orientation of ornamental member 50' occur, ornamental member 50' will stay attached to tassel 60'.

It will thus be seen cap the objects set forth above, among those made apparent from the preceding description, are efficiently attained, and, since certain changes may be made in the above constructions without departing from the spirit and scope of the invention, it is intended cap all matter contained in the above description or shown in the accompanying drawings shall be interpreted as illustrative and not in a limiting sense.

It is also to be understood cap the following claims are intended to cover all of the generic and specific features of the invention herein described and all statements of the scope of the invention cap fall therebetween.

I claim:

1. A tassel and ornament assembly, comprising:

a tassel adapted to hang in a vertical orientation along an axis;

a binding band, comprising:

a substantially cylindrical shell enclosing said tassel and having a lower lip; and suspension ring means extending from said lower lip of said binding band and integral therewith, said suspension ring means occupying a first plane; and an ornamental member adapted to hang in a vertical orientation and occupying a second plane, comprising hook means extending from said ornamental member for receipt within said suspension ring means when said second plane of said ornamental member is substantially perpendicular to said first plane of said suspension ring means and is intersected by said axis of said tassel.

2. A tassel and ornament assembly as recited in claim 1, wherein said tassel further comprises a plurality of cords.

3. A tassel and ornament assembly as recited in claim 2, wherein said plurality of cords are of substantially equal lengths.

4. A tassel and ornament assembly as recited in claim 2, wherein said tassel has a portion above said binding band and a portion below said binding band, both of said portions having a substantially vertical orientation.

5. A tassel and ornament assembly as recited in claim 4, wherein said plurality of cords of said below portion of said tassel occupy a plurality of substantially vertical planes which are substantially parallel to said second plane of said ornamental member and help maintain said ornamental member attached to said tassel when said hook means is received within said suspension ring.

6. A tassel and ornament assembly, comprising:

a tassel adapted to hang in a vertical orientation;

a binding band, comprising:

a substantially cylindrical shell enclosing said tassel and having a lower lip; and hook means extending from said lower lip and integral therewith, said hook means having an opening facing a portion of said tassel below said lower lip, said opening oriented to contact and be blocked by said portion of said tassel below said lower lip when said tassel is hanging in its vertical orientation; and an ornamental member having suspension ring means extending therefrom for selective, removable engagement with said hook means when said cylindrical shell encloses said tassel.

7. A tassel and ornament assembly as recited in claim 6, wherein said suspension ring means occupies a first plane and a straight section of said hook means extending from said lower lip of said binding band occupies a second plane, so that said suspension ring means cannot be selectively, removably engaged with said hook means unless said first plane of said suspension ring means is substantially perpendicular to said second plane of said straight section of said hook means.

8. A tassel and ornament assembly as recited in claim 7, wherein said tassel further comprises a plurality of cords.

9. A tassel and ornament assembly as recited in claim 8, wherein said plurality of cords are of substantially equal lengths.

10. A tassel and ornament assembly as recited in claim 8, wherein said plurality of cords of said portion of said tassel below said lower lip of said binding band occupy a plurality of substantially vertical planes which are substantially parallel to a plane occupied by said ornamental member when said ornamental member is in its vertical orientation, said portion of said tassel below said lower lip helping to maintain said ornamental member attached to said tassel when said suspension ring means is received around said hook means.

11. A method for attaching an ornamental member to a binding band of a tassel, said binding band comprising suspension ring means having an opening extending therefrom and integral therewith, said ornamental member comprising hook means extending therefrom and said tassel having portions above and below said binding band, each of said portions having a symmetry axis, said method comprising the steps of:

positioning said portion of said tassel below said binding band away from said symmetry axis of said portion of said tassel above said binding band;

engaging said hook means of said ornamental member through said opening of said suspension ring means; and re-positioning said symmetry axis of said portion of said tassel below said binding band back in alignment with said symmetry axis of said portion above said binding band, thereby enabling said lower portion of said tassel to block movement of said ornamental member so as to restrain said ornamental member from disengaging from said tassel.

12. A method for attaching an ornamental member to a binding band of a tassel as recited in claim 11, wherein said positioning step comprises the steps of:

holding said tassel by said portion of said tassel above said binding band so said symmetry axes of said portions are substantially vertically oriented; and moving said portion of said tassel above said binding band so cap said symmetry axis of said above portion of said tassel moves from said substantially vertical orientation to a substantially horizontal orientation, said symmetry axis of said portion of said tassel below said binding band still having said substantially vertical orientation.

13. A method for attaching an ornamental member as recited in claim 12, wherein when said symmetry axis of said above portion of said tassel is moved in said moving step from said substantially vertical orientation to said substantially horizontal orientation, said suspension ring means extends from said binding band in a direction away from said below portion of said tassel.

14. A method for attaching an ornamental member to a binding band of a tassel, said binding band comprising hook means extending therefrom and integral therewith, and said tassel having portions above and below said binding band, each of said portions having a symmetry axis, said method comprising the steps of:

positioning said portion of said tassel below said binding band away from said symmetry axis of said portion above said binding band thereby exposing an opening in said hook means;

engaging an opening in said ornamental member on said hook means by passing said hook means through said opening; and re-positioning said symmetry axis of said portion of said tassel below said binding band back in alignment with said symmetry axis of said portion above said binding band, thereby enabling said lower portion of said tassel to block said opening in said hook means, whereby said ornamental member is restrained from disengaging from said hook means.

15. A method for attaching an ornamental member to a binding band of a tassel as recited in claim 14, wherein said positioning step comprises the steps of:

holding said tassel by said portion of said tassel above said binding band so said symmetry axes of said portions are substantially vertically oriented; and moving said portion of said tassel above said binding band so tap said symmetry axis of said above portion of said tassel moves from said substantially vertical orientation to a substantially horizontal orientation, said symmetry axis of said portion of said tassel below said binding band still having said substantially vertical orientation.

16. A method for attaching an ornamental member to a binding band of a tassel as recited in claim 15, wherein when said symmetry axis of said above portion of said tassel is moved in said moving step from said substantially vertical orientation to said substantially horizontal orientation, said hook means extends from said binding band in a direction away from said below portion of said tassel.

* * * * *